United States Patent [19]

Barnes et al.

[11] 3,938,750

[45] Feb. 17, 1976

[54] STRAND DELAY DEVICE

[75] Inventors: Porter I. Barnes, Johnston; Carlton A. Steele, Warwick, both of R.I.

[73] Assignee: Leesona Corporation, Warwick, R.I.

[22] Filed: Sept. 5, 1974

[21] Appl. No.: 503,496

[52] U.S. Cl. ..... 242/36; 242/35.6 R
[51] Int. Cl.[2] ..... B65H 63/00; B65H 54/22
[58] Field of Search ..... 242/36, 37 R, 35.6 R; 28/64

[56] References Cited

UNITED STATES PATENTS 3,389,867 6/1968 Pitts ..... 242/35.6 R

*Primary Examiner*—Stanley N. Gilreath
*Attorney, Agent, or Firm*—Burnett W. Norton

[57] ABSTRACT

Winding apparatus is disclosed herein which includes a strand detection system having a fault sensing zone operable to receive a strand and detect faults therein as the strand moves through the zone. Mechanism is incorporated to delay re-entry of the strand into the fault sensing zone following detection of a fault in the strand which leads to removal of the strand from the system.

8 Claims, 4 Drawing Figures

STRAND DELAY DEVICE

BACKGROUND OF THE INVENTION

This invention relates generally to strand winding apparatus and relates, more specifically, to apparatus for sensing the presence and quality of a strand during the winding operation.

As employed in this specification and the claims appended, the term "strand" is employed in a general sense to refer to all kinds of strandular material, either textile or otherwise, and the designation "package" is intended to mean the product of a winding operation, whatever form the product may take.

It is known to use clearing devices, often referred to in the parlance of the textile trade as "slub catchers," in association with textile strand winding machinery which act to continually monitor a strand as it advances from the supply to the take-up package. Earlier yarn clearing devices mechanically sensed the strand and, more recently, improved yarn clearers have been introduced which electronically or electrooptically sense the strand. In operation with these devices, once a fault of the predetermined size is detected by the strand clearer, the strand is severed by a cutting mechanism initiated by the sensing unit. This leads to the elimination of the fault during which period the winding operation momentarily ceases. Thereafter, in known types of automatic strand winding machines the free end of the strand from the winding package is automatically united with the free strand end from the supply package and the winding cycle is recommenced.

Among numerous advantages, one important benefit of modern strand clearers resides in their ability to detect and remove strand faults according to the cross-sectional area of the faults and also according to their length. It is to be appreciated that all strands have some normal variation in their cross-sectional areas. very often, for example, strands can have short variations which are even 50 percent greater than the average cross-sectional area thereof. These may be deemed acceptable as long as variations of this magnitude remain relatively short in length. However, should such short variations reach a size, for example, 100 percent greater than the average cross-sectional area of the strand, they are deemed unacceptable and are eliminated by being cut out of the strand. In like manner, for example, should a strand exhibit an oversize variation of 50 percent for a considerable length, as in a so-called spinners double, this occurrence is also deemed unacceptable and is cut out of the strand.

A difficulty of some yarn clearers resides in their inability to distinguish between short and long variations in strand size when the strand is motionless in the sensing zone thereof. This can occur, for example, immediately following a yarn uniting sequence of an automatic winding machine when the strand is fed laterally into the sensing zone of the strand clearer with little or no forward motion. Thus, a short strand imperfection which remains within the sensing zone of the clearer for an extended period of time until winding of the strand by the automatic winding machine recommences is often treated by the sensing apparatus as identical to an elongated imperfection of like cross-section in an advancing strand. This may result in the strand being severed when, in fact, the true nature of the fault is such as to render that section of the strand acceptable for winding.

Thus, the present invention represents a significant advance in the art of strand winding by enabling modern strand clearers to distinguish between acceptable and unacceptable variations in strand size. Pursuant thereto, the invention is of a construction which operates to engage a strand and hold it away from the sensing zone of a strand clearing device when the strand is not advancing toward the take-up package, but which is responsive to the subsequent movement of the strand to release it so that the strand will return to the sensing zone, which resides in the usual strand path, when the strand is once again advanced to the take-up machanism.

In accordance with the foregoing it is one object of the present invention to provide a new and novel means for detecting faults in a winding strand and avoiding false indications of faults by the fault detection unit.

Another object of the invention is to provide a winding machine incorporating strand inspection means and delay means engageable with the strand being wound to hold the strand away from the inspection means during an interval when a strand uniting cycle is being performed by the winding means to reunite the winding end of strand with the supply end of strand.

A further object of the invention is to provide a novel means of detecting faults in a winding strand wherein a sensing zone is provided for detecting undersirable faults in said strand, and retaining means are engageable with the strand operable to hold a portion thereof away from the sensing zone when the strand is at rest and yet to provide means for releasing the retaining means to permit entry of the strand into the fault sensing zone when advance of the strand to the winding mechanism is recommenced.

Other further objects of the invention will be obvious and will appear hereinafter.

DESCRIPTION OF THE PREFERRED EMBODIMENT

The invention herein may be applied to an automatic winding machine of the type disclosed in commonly assigned U.S. Pat. No. 2,764,362 to W. V. Goodhue et al, although it will be readily apparent that it is capable of utilization with a wide variety of other forms of winding machines. For convenience, the invention will be described in connection with a winding machine of the type generally disclosed in the afore-cited patent. Since the automatic winding machine per se is well known in the art, no attempt will be made to provide a complete description of that automatic winding machine but, rather, reference is made to U.S. Pat. No. 2,764,362 for such further particulars of that automatic winding machine as may be desired. It will be usefull however, to describe certain features of the automatic winding machine to set forth the context in which the present invention is utilized.

Figure 1:
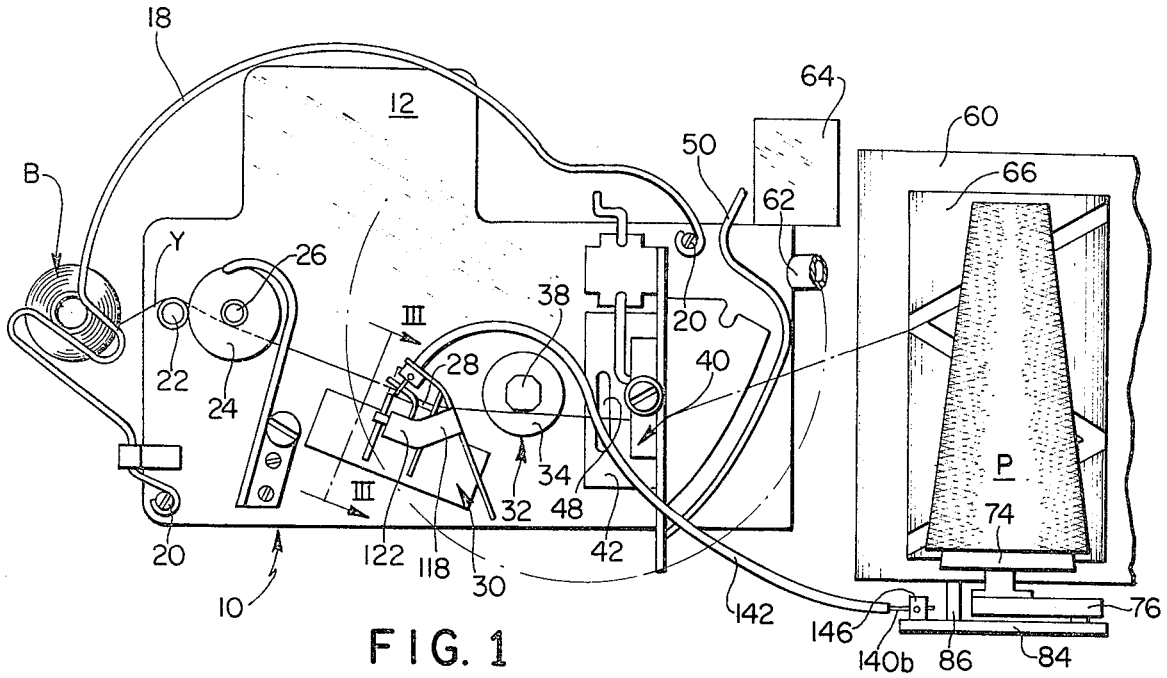
FIG. 1 is a plan view of a portion of a strand winding machine incorporating the present invention.
Figure 2:
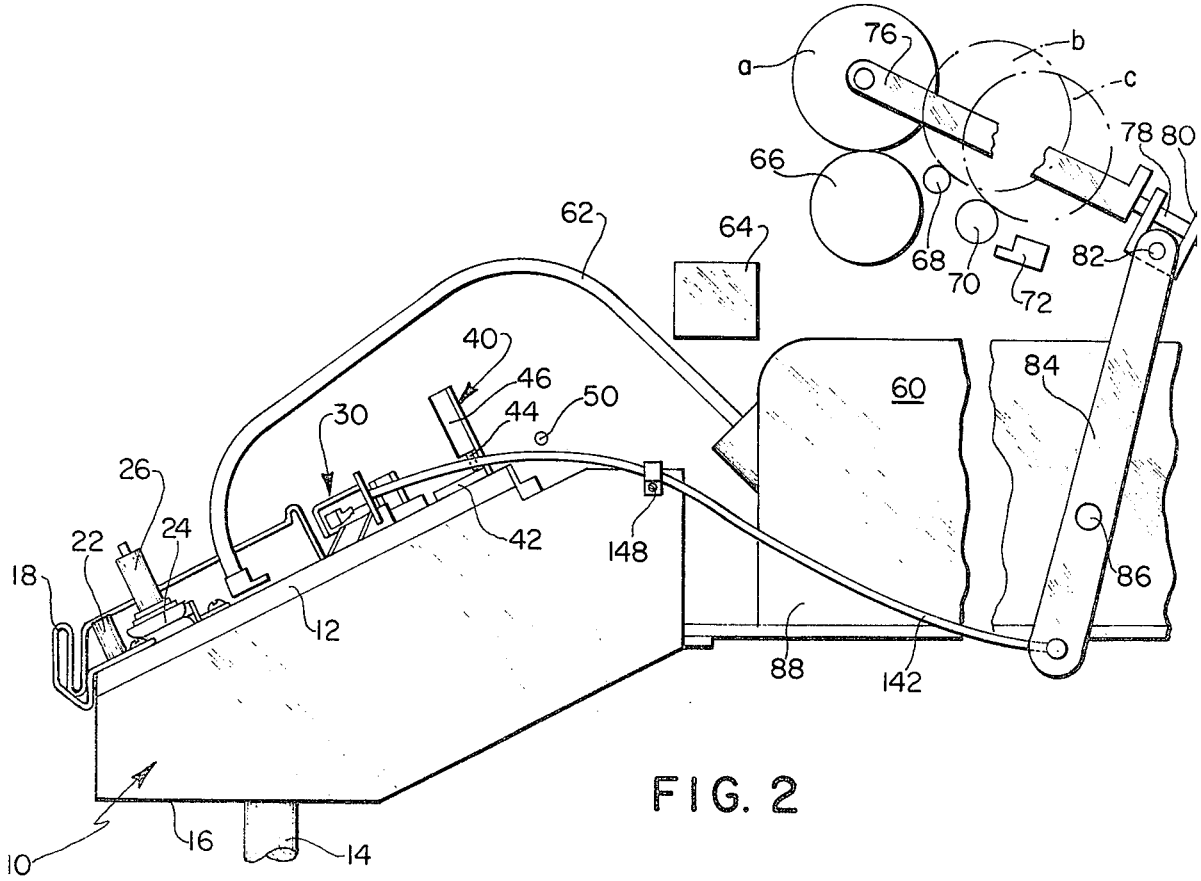
FIG. 2 is generally a side elevational view of the structure of FIG. 1.

With attention initially to FIGS. 1 and 2 of the drawing it will be seen that the automatic winding machine includes a control unit 10 which is generally in the shape of an elongated box and which, of interest for present purposes, includes a top panel 12 forming a cover for the control unit. A tubular shaft 14 projects through an aperture in the lower wall 16 of control unit 10 and is provided at its lower end with a spider (not shown) on which a plurality of yarn supply packages in the form of bobbins or cops are mounted. One such bobbin or cop B is depicted in an active unwinding position in FIG. 1. A supply strand of yarn Y is drawn off the vertically oriented active unwinding bobbin B and is guided upwardly therefrom and across the surface of top panel 12 to ultimately be taken up in the form of a package P. In the course of its movement across the top panel 12 strand Y is guided and serviced by a plurality of mechanisms which include a yarn guiding bail 18 affixed at its opposite ends to panel 12 by screws 20. After strand Y has been guided over the bail it is directed around a post 22 and through a disc-type tension array 24 which is adapted to impose tension on the strand as it travels to package P. Centrally disposed within tension array 24 is a plunger 26 which, as more particularly set forth in U.S. Pat. No. 3,081,845, is operable to normally support the advancing strand. In the event of exhaustion of the supply strand from bobbin B or in the event the strand breaks in the region of the supply bobbin plunger 26 operates to move downwardly and reinitiate a supply bobbin replenishing cycle.

From tension array 24 strand Y advances through the sensing zone 28 of a strand inspection device 30 which may be of the type well known in the art which is operable electronically or electro-optically to sense strand presence or absence as well as to detect objectional faults in the strand. From the strand inspection device 30 strand Y is guided to a waxing attachment 32 which applies wax to the advancing strand as desirable. Waxing attachment 32 takes the form of a cake of wax 34 having a central aperture therethrough of polygonal configuration and positioned on a shaft 38 whose upper end is correspondingly shaped to mate with the aperture through the wax cake 34 whereby the shaft and cake rotate together. Shaft 38 is journaled for rotation in top panel 12 and is rotated by mechanism within control unit 10. In consequence thereof wax from cake 34 is applied to strand Y as it advances beneath the cake.

Positioned on control panel 12 forwardly of waxing attachment 32 in the direction of advance of strand Y is strand cutting mechanism 40. This mechanism includes a platen or anvil 42 mounted on the upper surface of top panel 12. A blade 44 extends from blade actuating unit 46 and terminates in close proximity to anvil 42, a clearance being set between the lower end of blade 44 and the upper surface of anvil 42 so that strand Y may freely pass therebetween in the course of its advance to package P. Blade actuating unit 46 is connected through suitable circuitry with strand inspection device 30 and operates in response to a signal from the inspection device, indicating an unacceptable imperfection in the strand, to shift blade 44 downwardly toward anvil 42 and cut the advancing strand before the imperfection detected in the sensing zone 28 of inspection unit 30 can advance beyond the strand cutting mechanism. In this fashion strand portions having unacceptable imperfections therein are precluded from being wound onto package P. During the strand reuniting cycle as set forth in U.S. Pat. No. 2,764,362, these imperfections are eliminated from the strand during the knotting procedure.

As seen in FIG. 1 a suction slot 48 is formed in anvil 42 on the upstream side of blade 44 considering the direction of advance of strand Y. Suction slot 48 is connected with a suitable suction source and functions to clean the strand prior to its delivery to package P and also operates to entrain the free strand end extending from supply bobbin B in the event that blade 44 is operated to break the advancing strand. Viewing FIGS. 1 and 2 a breakage lever 50 extends generally across the width of top panel 12. The inner end of breakage lever 50 is connected with instrumentalities enclosed within a housing 60. Breakage lever 50 is biased upwardly, but is restrained in a downward position by the strand Y passing over it. Upon upward movement of breakage lever 50 in response to its release by the absence of a strand extending thereacross which normally acts to hold the breakage lever in a depressed condition, instrumentalities within housing 60 are initiated to effect a strand end finding cycle. In the course of this end finding cycle a suction nozzle 62 initially swings forwardly in a clockwise direction (FIG. 1) from a rest position adjacent a knotter 64 to endeavor to locate the strand in the region of the yarn sensing and tensioning devices 24, 26. In the course of its subsequent operation, suction nozzle 62 operates in an opposite sense, i.e., in a counterclockwise direction viewing FIG. 1, to deliver the free strand end extending from bobbin B to knotter 64 so that the strand end from supply bobbin B can be joined together by the operation of knotter 64 with the free strand end from package P. As a further step in this end reuniting cycle, package P which, when in its active winding position is resting in peripheral contact with a grooved transverse roll 66, is shifted initially onto a rest plate or roll 68 where the package is skidded to a stop. Once rotation of the package is halted it is sequentially shifted onto a reverse roll 70 where the package is rotated in a sense opposite to the sense in which the strand is wound thereon in order that the free outer strand end on the package can be entrained in a suction unit 72. In FIG. 2 the position of package P when its active winding position on traverse roll 66 is illustrated by the letter a. The letter b illustrates the package positioned on rest plate 68 and the position of the package illustrated by the letter c depicts the package engaged on reverse roll 70.

As seen in FIGS. 1 and 2 package P is mounted on an arbor 74 which, in turn, is positioned on the outer end of a package supporting arm 76 for rotation. Arm 76 is provided with an extension 78 which is rotatably held in a bearing collar 80. At its lower end bearing collar 80 is pivoted on a stub shaft 82 pierced through the upper end of a heavy elongated generally vertically oriented link 84 which is herein designated the "main package support arm". As illustrated in FIG. 2 main package support arm 84 is pivoted toward its lower end on the exterior end of a shaft 86 journaled in suitable bearings in a sidewall 88 of housing 60. The interior end of shaft 86 is connected with instrumentalities within housing 60 for effecting the operation of main package support arm 86 and package P.

Figure 3:
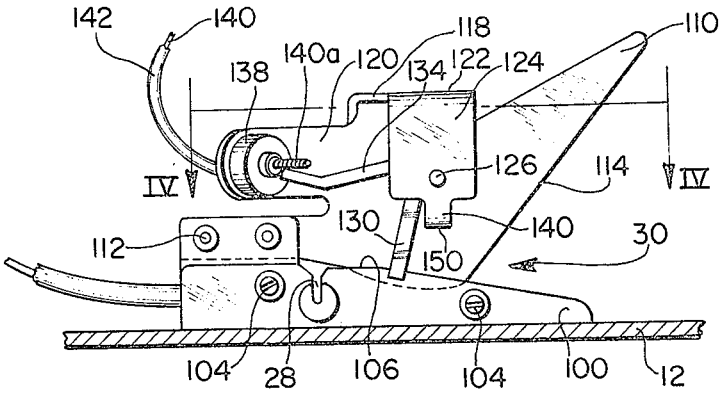
FIG. 3 is a view taken along lines III—III of FIG. 1.
Figure 4:
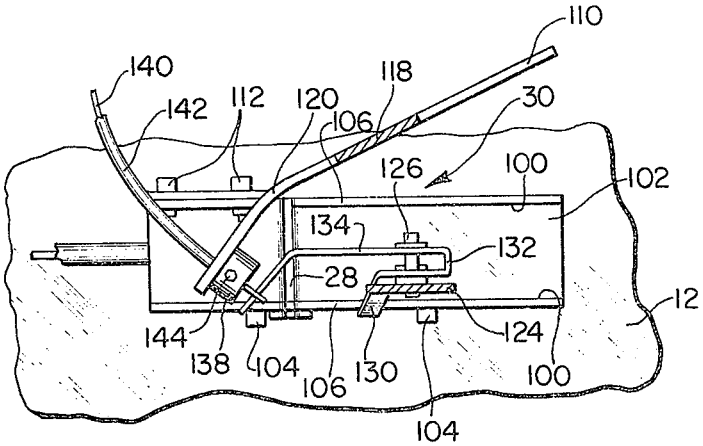
FIG. 4 is a detailed view taken along lines IV—IV of FIG. 3.

With the foregoing generalized description of portions of the automatic winding machine having now been presented it will be useful at this juncture to direct attention to FIGS. 3 and 4 where details of strand inspection device 30 are shown. It will be observed that strand inspection device 30 includes a pair of spaced, inclined ramps 100 across which strand Y is laterally moved as the strand is conveyed toward knotter 64 by suction nozzle 62. Ramps 100 are fastened to a central chassis 102 by screws 104 and terminate at the upper ends of their inclined paths in flat surfaces 106 which falls off into sensing slot 28. Accordingly, as strand Y is delivered toward knotter 64 by suction nozzle 62 the strand is engaged on ramp 100. An elongated wing like member 110 is affixed to the side of chassis 102 by means of screws 112 and has a smooth sloping surface 114 which guides strand Y into engagement with ramps 100 as the taut strand Y is carried toward knotter 64 via suction nozzle 62. Integrally formed with member 110 and along the upper edge thereof are a pair of tabs 118 and 120. As best seen in FIG. 3 tab 118 is bent at a right angle at its outer end to form an extension 122. In turn, extension 122 has a depending appendage 124 folded downwardly therefrom. A pin 126 is pierced through appendage 124 in a position extending toward member 110. A strand retainer 130 having an upper end formed in U-shape configuration as at 132 is rockably mounted on pin 126, the pin passing through the opposing upper U-shaped ends of strand retainer 130. The lower end of strand retainer 130 depends below the surface of the forwardmost ramp 100, viewing FIG. 3. Integrally connected with strand retainer 130 and extending outwardly in a position approximately at a right angle to the strand retainer is an arm 134 which acts as a latch for said strand retainer. For purposes of securing latch 134 in position tab 120 is provided at its outer end with a bushing 138. A push-pull cable 140 is slidably enclosed within the usual sheath 142, the sheath being engaged in bushing 138 and secured therein by means of a set screw 144. Push-pull cable 140 has a forward end 140*a* which, when in its extended position, enters into a plane just above latch 134 and precludes upward movement of the latch, thereby maintaining strand retainer 130 in a position depending into blocking engagement with a strand moving up ramps 100. The opposite end 140*b* of push-pull cable 140 is connected to the lower end of main package support arm 34 by a suitable connector 146. Sheath 142 is affixed in position on control unit 10 and housing 60 by appropriately spaced clips 148.

In operation, as package P is shifted off traverse roll 66 (position *a*), as when a break in the winding strand occurs or when the strand supply becomes exhausted, push-pull cable 140 is thrust forward by the clockwise motion of main package support arm 84, viewing FIG. 2, as package P is first shifted rearwardly onto rest plate 68 (position *b*) and sequentially onto reverse roll 70 (position *c*). In consequence thereof the forward end 140*a* of push-pull cable 140 is extended into a position just above latch 134. Thereupon as suction nozzle 62 is rocked clockwise, viewing FIG. 1, to entrain the outer strand end from supply bobbin B and is subsequently shifted in a counterclockwise direction to deliver that outer strand end to knotter 64, the outer strand end from supply bobbin B is engaged on surface 114 of member 10 and drawn up ramps 100. However, as the outer strand end attempts to progress onto surface 106 and into sensing slot 28 it is intitially precluded from such movement due to its encountering retainer 130. The strand is held in engagement with retainer 130 while strand reuniting at knotter 64 is achieved. Thereafter and in the manner fully disclosed in U.S. No. 2,764,362 package P is returned from position *c* through position *b* to position *a* where it engages on the surface of the constantly rotating traverse roll 66. During the movement of package P from position *c* to position *b* main package support arm 84 is, of course, rocked counterclockwise in consequence of which the forward end 140*a* of push-pull cable 140 is withdrawn from its position interfering with the rocking motion of latch 134. As a result thereof as package P moves from position *b* to position *a* strand Y is temporarily restrained from entry into sensing slot 28 due simply to the fact that the inherent mass of retainer 130 holds the retainer in a depending position as shown in FIG. 3. However, once significant tension is introduced into strand Y as when package P reaches position *a* engaging the peripheral surface of traverse roll 66 and commences to rotate, the tension in the strand produced thereby is sufficient to swing retainer 130 clockwise, viewing FIG. 3, and permits strand Y to pass therebeneath, over surfaces 106 and into sensing slot 28. Once the strand has passed beneath retainer 130, the retainer rocks back to the position as shown in FIG. 3. Counterclockwise rotation of retainer 130 is limited by means of a tab 150 which is bent inwardly and which interferes with further counterclockwise rotation of retainer 130 beyond its generally vertically depending position.

From the foregoing it will be seen that the present invention provides a new and advantageous strand detection system wherein a fault sensing zone which operates to receive a strand and detect faults has cooperatively positioned therewith a strand retaining unit which is operable to preclude entry of a strand into the fault sensing zone during a first interval and which is operable thereafter to permit entry of the strand into the fault sensing zone. By so operating, the present invention serves to enable the strand detection system to properly distinguish between acceptable and unacceptable variations in strand size and permits the strand detection system to opeate with superior efficiency.

Since certain changes may be made in the above apparatus without departing from the scope of the invention therein involved, it is intended that all matter contained in the above description or in the accompanying drawing shall be interpreted as illustrative only and not in a limiting sense.

What is claimed is:

1. In a strand detection system having a fault sensing zone operable to receive a strand and detect faults therein as the strand moves through said zone, the combination therewith of strand retaining means movable in a path between a first location for retaining said strand against entry into said zone and a second location remote from said first location where said strand is released for entry into said zone, securing means adapted to be positioned in said path for preventing said retaining means from moving away from said first location, and means for displacing said securing means from said path to permit said retaining means to move to said second position and afford passage of said strand into said zone.

2. Apparatus as set forth in claim 1 including means for advancing said strand in a predetermined threadline, said zone being positioned in said threadline, means for advancing said strand in an alternate path to said threadline, said retaining means being disposed intermediate said threadline and said alternate path.

3. Apparatus as set forth in claim 1 wherein said retaining means includes a strand engaging portion, and means mounting said strand engaging portion for rocking motion in response to movement of said strand toward said fault sensing zone when said securing means is displaced from said path.

4. Apparatus as set forth in claim 3 wherein said retaining means includes a latching portion, said securing means overlaying said latching portion to secure said retaining means in said first location.

5. Apparatus as set forth in claim 3 wherein when said retaining means is in said first location said strand engaging portion is positioned to extend in a path to preclude entry of said strand into said zone, and said mounting means mounts said strand engaging portion to normally extend in said path.

6. Apparatus as set forth in claim 1 including a supply of said strand located at a first position said means for displacing said securing means including winding means for collecting said strand, said winding means being located at a second position remote from the first position, said fault sensing zone being disposed intermediate said first and second positions.

7. Apparatus as set forth in claim 6 wherein said strand advances in a predetermined threadline as said strand is advanced from said first to said second position, said zone being positioned in said, threadline means for advancing said strand in an alternate path to said threadline upon an interruption in the movement of the strand to said second position, said retaining means being disposed intermediate said threadline and said alternate path.

8. Apparatus as set forth in claim 6 wherein said winding means is movable from an active winding position to an inactive position for the location of the outer strand end thereon when strand movement to the package is interrupted and said winding means is movable thereafter to said active unwinding position, and said securing means includes a slidable member connected with said winding means, said slidable member being displaced from said path to permit said retaining means to move to its second location in response to movement of said winding means to said active winding position.

* * * * *